US009926812B2

(12) United States Patent
Ternel et al.

(10) Patent No.: US 9,926,812 B2
(45) Date of Patent: Mar. 27, 2018

(54) DEVICE FOR CONTROLLING A WORKING FLUID ACCORDING TO A RANKINE CYCLE AND METHOD USING SAME

(75) Inventors: Cyprien Ternel, Sevre (FR); Pierre Leduc, Beynes (FR); Alexandre Duparchy, Paris (FR)

(73) Assignee: IFP ENERGIES NOUVELLES, Rueil Malmaison (FR)

( * ) Notice: Subject to any disclaimer, the term of this patent is extended or adjusted under 35 U.S.C. 154(b) by 155 days.

(21) Appl. No.: 13/020,938

(22) Filed: Feb. 4, 2011

(65) Prior Publication Data

US 2011/0192178 A1 Aug. 11, 2011

(30) Foreign Application Priority Data

Feb. 11, 2010 (FR) ..... 10 00572

(51) Int. Cl.

*F25B 39/04* (2006.01)
*F01K 13/00* (2006.01)
*F01K 23/06* (2006.01)

(52) U.S. Cl.

CPC ..... *F01K 13/00* (2013.01); *F01K 23/065* (2013.01)

(58) Field of Classification Search

CPC .... F01K 13/00; F01K 23/065; F25B 2400/16; F25B 2339/044; F25B 37/50; F22D 1/02
USPC ..... 62/509, 149, 238.4, 179, 292, 324.4, 77
See application file for complete search history.

(56) References Cited

U.S. PATENT DOCUMENTS

| | | | | |
|---|---|---|---|---|
| 4,192,144 | A * | 3/1980 | Pierce | F01K 3/00 122/28 |
| 4,334,409 | A * | 6/1982 | Daugas | 60/618 |
| 6,829,894 | B2 * | 12/2004 | Bloch et al. | 60/646 |
| 6,948,316 | B2 * | 9/2005 | Minemi et al. | 60/671 |
| 7,891,211 | B2 * | 2/2011 | Aikawa | 62/434 |
| 8,096,128 | B2 * | 1/2012 | Held | F01K 3/185 60/645 |
| 2004/0055300 | A1 * | 3/2004 | Lawheed | 60/641.8 |
| 2004/0107700 | A1 * | 6/2004 | McClanahan et al. | 60/670 |
| 2007/0167983 | A1 * | 7/2007 | Vago | A61H 23/0245 607/2 |
| 2009/0020110 | A1 * | 1/2009 | Lauritzen | 126/590 |
| 2009/0266075 | A1 * | 10/2009 | Westmeier et al. | 60/651 |
| 2009/0277198 | A1 * | 11/2009 | Yamaguchi et al. | 62/118 |
| 2009/0277400 | A1 * | 11/2009 | Conry | 123/2 |

(Continued)

FOREIGN PATENT DOCUMENTS

| | | | |
|---|---|---|---|
| DE | 102 28 868 | A1 | 1/2004 |
| EP | 1 806 533 | A1 | 7/2007 |

(Continued)

*Primary Examiner* — Len Tran
*Assistant Examiner* — Ana Vazquez
(74) *Attorney, Agent, or Firm* — Fitch, Even, Tabin & Flannery, LLP

(57) ABSTRACT

The present invention relates to a device for controlling the working fluid with low freezing point circulating in a closed circuit (10) operating according to a Rankine cycle, said circuit including a compression pump (12) for the fluid in liquid form, a heat exchanger (22) swept by a hot source (28) for evaporation of said fluid, an expander (30) for expanding the fluid in vapor form and a cooling exchanger (40) swept by a cold source (F) for condensation of the working fluid. According to the invention, the device includes a fluid collection tank for draining said circuit.

24 Claims, 1 Drawing Sheet

(56) References Cited

U.S. PATENT DOCUMENTS

| | | | | |
|---|---|---|---|---|
| 2010/0038052 | A1* | 2/2010 | Johnson et al. | 165/45 |
| 2011/0041523 | A1* | 2/2011 | Taras | F25B 9/008 62/77 |
| 2011/0056203 | A1* | 3/2011 | Gartner | F01K 15/02 60/670 |
| 2014/0096524 | A1* | 4/2014 | Held et al. | 60/651 |

FOREIGN PATENT DOCUMENTS

| | | |
|---|---|---|
| FR | 2 884 555 A1 | 10/2006 |
| GB | 750071 | 6/1956 |

* cited by examiner

DEVICE FOR CONTROLLING A WORKING FLUID ACCORDING TO A RANKINE CYCLE AND METHOD USING SAME

FIELD OF THE INVENTION

The present invention relates to a device for controlling a working fluid with low freezing point, in particular water, contained in a closed circuit operating according to a Rankine cycle, and to a method using same.

It notably aims to associate this device with an internal-combustion engine, in particular for motor vehicles.

As it is widely known, a Rankine cycle is a closed-circuit thermodynamic cycle whose specific feature is to involve a (liquid/vapour) phase change of a working fluid.

This cycle is generally broken down into a stage wherein the working fluid used, water here, in liquid form, is compressed in an isentropic manner, followed by a stage where this compressed water is heated and vaporized on contact with a source of heat, this water vapour is then expanded, in another stage, in an isentropic manner in an expansion machine, then, in a last stage, this expanded vapour is cooled and condensed on contact with a cold source.

To carry out these various stages, the circuit comprises a positive-displacement pump (or compressor) for compressing the water in liquid form, a heat exchanger (or evaporator) that is swept by a hot fluid for at least partial vaporization of the compressed water, an expansion machine for expanding the vapour, such as a turbine that converts the energy of this vapour into another energy such as a mechanical or electrical energy, and another heat exchanger (or condenser) by means of which the heat contained in the vapour is yielded to a cold source, generally outside air that sweeps this condenser so as to convert this vapour into water in liquid form.

BACKGROUND OF THE INVENTION

It is also well known, notably through document FR-2,884,555, to use the calorific energy conveyed by the exhaust gas of internal-combustion engines, in particular those used for motor vehicles, as the hot source providing heating and vaporization of the fluid flowing through the evaporator.

This allows to improve the energy efficiency of this engine by recovering a large part of the energy lost at the exhaust in order to convert it to an energy that can be used for the motor vehicle through the Rankine cycle circuit.

The selection of this working fluid, which undergoes a succession of liquid/vapour phase transformations, is therefore determining.

In fact, the saturation curve of this fluid has to be optimized according to the temperature of the hot source and of the cold source.

Using an aqueous working fluid in a Rankine cycle circuit therefore affords the advantage of having characteristics allowing to obtain a maximum saturation curve while having the advantage of not being dangerous.

However, water has the specific feature of having a freezing point at low temperatures (around 0° C.) and antifreeze additives such as glycol are usually added thereto in order to lower this freezing point to acceptable temperature levels, of the order of −15° C. to −30° C.

Adding such additives has the drawback of changing the characteristics of water, in particular its vaporization characteristics, and the hot source from the exhaust gas may be insufficient to perform this vaporization in a satisfactory manner.

Furthermore, in the course of time, this additive-containing water undergoes unpredictable aging as the liquid/vapour phase changes take place. This unpredictable aging can lead to incomplete phase changes for this water, which generates a Rankine cycle circuit dysfunction.

The present invention aims to overcome the aforementioned drawbacks by means of a device and of a method that limit or even prevent freezing of the working fluid without causing changes in the liquid/vapour phase transformation characteristics.

SUMMARY OF THE INVENTION

The present invention therefore relates to a device for controlling the working fluid with low freezing point circulating in a closed circuit operating according to a Rankine cycle, said circuit comprising a compression pump for the fluid in liquid form, a heat exchanger swept by a hot source for evaporation of said fluid, expansion means for expanding the fluid in vapour form and a cooling exchanger swept by a cold source for condensation of the working fluid, characterized in that it comprises a fluid collection tank for draining said circuit.

The tank can be an insulated tank, an expansible tank, a tank whose capacity is larger than the volume of the fluid contained in the circuit.

The tank can comprise a system for heating the fluid contained therein.

The device can comprise at least one line connecting the circuit to the tank.

The device can comprise a line for draining off the fluid from the circuit into the tank and a line for filling the circuit with the fluid from this tank.

Preferably, the line can comprise a valve.

At least one of the lines can comprise a fluid circulation pump.

At least one of the lines can be connected to a point of a circulation line between the compression pump and the heat exchanger for evaporation of said fluid.

The circulation line can be provided with a valve located between the point and the heat exchanger for evaporation of said fluid.

Preferably, the working fluid can be water without an antifreeze additive.

The hot source can come from the exhaust gas of an internal-combustion engine.

The invention also relates to a method of controlling a working fluid with low freezing point circulating in a closed circuit operating according to a Rankine cycle, said circuit comprising a compression pump for the fluid in liquid form, a heat exchanger swept by a hot source for evaporation of said fluid, expansion means for expanding the fluid in vapour form and a cooling exchanger swept by a cold source for condensation of the working fluid, characterized in that it consists, while the circuit is turned off, in transferring at least part of the fluid contained in said circuit into a tank.

The method can consist in transferring the fluid to the tank, while the circuit is turned off, when the ambient temperature is below the freezing temperature of the fluid.

The method can consist in transferring the fluid contained in the tank to the circuit when the circuit is turned on.

The method can consist in circulating the fluid in a line connecting the circuit to the tank under the action of the compression pump.

The method can consist in circulating the fluid in a line connecting the circuit to the tank under the action of a circulation pump carried by said line.

The method can consist in transferring through gravity the fluid contained in the tank into the circuit when the circuit is turned on.

BRIEF DESCRIPTION OF THE FIGURES

Other features and advantages of the invention will be clear from reading the description hereafter, given by way of non limitative example, with reference to the accompanying figures wherein.

DETAILED DESCRIPTION

Figure 1:
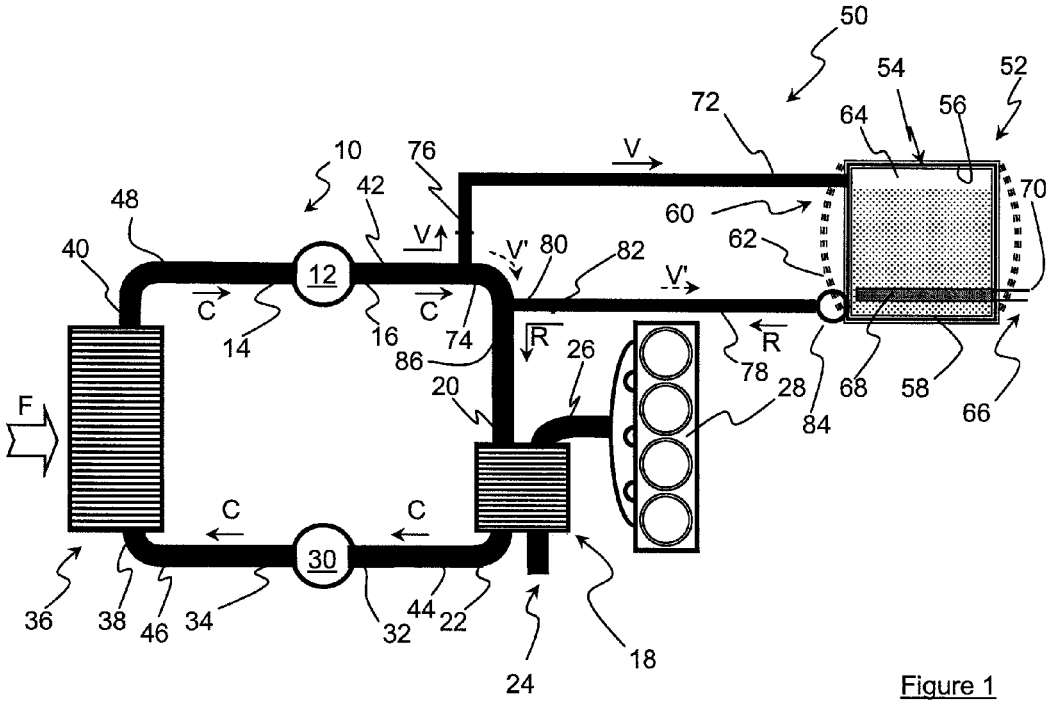
FIG. 1 shows a device for controlling a closed circuit operating according to a Rankine cycle.

In FIG. 1, Rankine cycle closed circuit 10 comprises a circulation and compression pump 12 (or compressor) for a working fluid, with an inlet 14 for the working fluid in liquid form and an outlet 16 for this working fluid, also in liquid form, but compressed at high pressure. This compressor is advantageously driven in rotation by an electric motor (not shown).

This circuit also comprises a heat exchanger 18, referred to as evaporator, traversed by the compressed working fluid between an inlet 20 for this liquid fluid and an outlet 22 through which the working fluid flows out of this evaporator in form of compressed vapour. This evaporator is swept by a hot source 24 coming from the exhaust gas circulating in exhaust line 26 of an internal-combustion engine 28, and more particularly an engine for motor vehicles.

This circuit also comprises an expansion machine 30, referred to as expander, receiving through its inlet 32 the working fluid in form of high-pressure compressed vapour, this fluid flowing out through outlet 34 of the expander in form of low-pressure expanded vapour.

Advantageously, this expander can come in form of an expansion turbine whose rotor is driven in rotation by the working fluid in vapour form while driving a connecting shaft (not shown). Preferably, this shaft allows to transmit the energy recovered to any transformer device such as, for example, an electric generator.

The circuit also comprises a cooling exchanger 36, or condenser, with an inlet 38 for the expanded low pressure vapour and an outlet 40 for the working fluid converted to liquid form after passing through this condenser. The condenser is swept by a cold source, generally a cold fluid (arrow F), with air at ambient temperature, in order to cool the expanded vapour so that it condenses and is converted to liquid.

Fluid circulation lines 42, 44, 46 and 48 allow to connect successively the various elements of this circuit so that the fluid circulates in the direction shown by arrows C. More precisely, line 42 connects the compressor outlet to the evaporator inlet, line 44 connects the outlet of this evaporator to the expander inlet, line 46 connects the expander outlet to inlet 42 of the condenser, and line 48 connects the condenser outlet to the compressor inlet.

In the description below, water is mentioned as the working fluid with low freezing point (around 0° C.) circulating in this circuit. This water has the specific feature of comprising no additive and, more particularly, no additive preventing freezing thereof. Any other (liquid/vapour) phase change fluid without antifreeze additive, that can freeze at low temperature (around 0° C.), can be used as the working fluid, such as organic fluids for example.

As illustrated in this figure, a working fluid control device 50 with means for storing the water contained in the circuit is associated with this circuit.

These means comprise a closed storage tank 52 for storing the water collected after draining the circuit. This tank allows to keep this water in the liquid state even when the ambient temperature is at a level that can cause it to freeze or allows it to freeze without damage risks for the tank and/or the circuit.

More precisely, the tank is an insulated tank 54 with a peripheral coating 56 that covers all or part of its walls 58 and insulates it thermally from the ambient air.

Alternatively, the tank is an expansible tank 60 with at least part of its walls 62 elastically deformable under the effect of the volume increase of the frozen water.

A tank of large volume can also be used. The configuration of this tank is such that it has an inner volume that is greater than the volume of the water contained in the circuit and leaves a gas overhead 64 between the water level and the upper wall of this tank. This gas overhead comprises a volume that is at least equal to the volume increase of the water after freezing.

In all the aforementioned tank layouts, the tank can comprise a system 66 for heating the liquid contained in the tank. This system comprises, by way of example, an electric resistance heater 68 arranged within this tank and supplied by electric conductors 70.

Of course, any control means known to the person skilled in the art are connected to this heating system so as to control and/or actuate it with, for example, ambient temperature measurement by means of a temperature detector.

This tank is connected to circulation line 42 by a drain line 72 starting in the upper part of this tank and ending at a connection point 74 with line 42. This drain line is fitted with a two-position valve 76, providing a fully open and a fully closed position, allowing the water circulation in this line to be controlled. A filling line 78 also connects the tank bottom to a junction point 82 with line 42. This filling line also comprises a two-position valve 82, providing a fully open and a fully closed position, and a circulation pump 84, preferably electric, which allows the water circulation in this line to be controlled. Preferably, the drain and filling lines can be insulated so as to limit freezing of the water contained in these lines.

Finally, line 42 is fitted with a control valve 86 arranged downstream from the two junction and connection points and upstream from inlet 20 of evaporator 18.

Of course, valves 76, 82 and 86 are controlled by any known means such as electric motors, under the control of a processing unit and more particularly of the calculator of the internal-combustion engine.

Similarly, this processing unit controls the motors driving compressor 12 and pump 84.

During operation, the water only circulates in the circuit in a clockwise motion considering FIG. 1 (arrows C). The drain 76 and filling 82 lines are therefore in closed position for lines 72 and 78, whereas valve 86 is in open position for line 42. Pump 84 is inactive and compressor 12 is driven in rotation by its electric motor.

In this configuration, the water leaves compressor 12 in liquid form at a pressure of the order of 10 bars and a temperature close to 50° C. This compressed water circulates in line 42 and ends in evaporator 22, control valve 86 being open; it cannot circulate in lines 72 and 78 that are closed by valves 76 and 82. This compressed water flows through the evaporator so as to be converted to vapour under the effect of the heat sweeping this evaporator and coming from the exhaust gas of engine 28. The water vapour flowing from the evaporator is carried by line 44 and flows through expander 30 while transmitting thereto the energy it contains. The expanded water vapour leaving this expander circulates in line 46 and flows through condenser 36 where it is converted to liquid water. This liquid water is then brought through line 48 to compressor 12 in order to be compressed.

When the Rankine cycle circuit is turned off, the processing unit controls control valve 86 so as to prevent any circulation of the compressed water contained in line 42 towards the inlet of evaporator 18 while maintaining the closed position of filling valve 82 for filling line 78 and keeping pump 84 inactive.

This unit also controls drain valve 76 so that it is in open position for drain line 72 in order to establish a communication between line 42 and tank 52 through connection point 74 and this drain line 72.

Driving of compressor 12 is maintained and the water that leaves compressor 12 is fed into filling line 72 through point 74 in order to be transferred to tank 52, here at the top of the tank, as shown by arrows V in FIG. 1.

Of course, the person skilled in the art is able to calculate the time when driving of the compressor is stopped so as to completely drain off the water from the circuit and to store it in the tank, or at least so that only a minimum volume of water remains in the circuit which, if it should freeze, would not damage the elements of the circuit.

Similarly, the person skilled in the art will position as close as possible to outlet 16 of compressor 12 the connection 74 and branch connection 80 lines, as well as control valve 86, and limit the extent of lines 72 and 78. This allows to limit the zones where the residual water can freeze.

The water stored in the tank, and which is initially at the compressor outlet temperature (of the order of 50° C.), is then protected against freezing risks by insulation 56 of insulated tank 54, or it can freeze, either by deforming the walls of deformable tank 60, or by occupying the volume of gas overhead 64 of the large-volume tank without damaging the integrity of this tank.

Of course, one may consider starting heating system 66 when its control means detect an ambient air temperature likely to generate freezing of this water. In the case of water freezing in the tank, heating system 66 is actuated by the calculator so as to thaw this water in order to turn on circuit 10.

When turning on the Rankine cycle circuit again, control valve 86 is in open position for circulation line 42, valve 76 is in closed position for filling line 72 and valve 82 is in open position for filling line 78.

Compressor 12 and pump 84 are actuated, which results in feeding into line 42, through junction point 80, the water contained in the tank. This water is discharged from the tank under the action of the pump and circulates in filling line 78, then in line 42 as shown by arrows R in FIG. 1. This water fed into line 42 is then circulated in circuit 10 under the effect of compressor 12 and undergoes various phase changes, as mentioned above.

The person skilled in the art will parametrize the operating time of pump 84 so as to determine when to stop it after feeding again all of the water from the tank into circuit 10. Alternatively, a detection means such as a float can be placed in the tank and control the interruption of pump 84 when this float detects no presence of water in the tank.

Within the scope of FIG. 1, it can be considered removing drain line 72 and its valve 76, and using only line 78 with its valve 82 and its pump 84 as the drain and filling line, the particular feature of pump 84 being that it is a bidirectional pump.

In this case, when the circuit is turned off, valve 86 is in closed position for line 42 and valve 82 is in open position for line 42. Compressor 12 and pump 84 are actuated in the same direction of rotation so as to feed the water from the circuit into line 78, then to the bottom of tank 52 as shown by arrows V'.

When turning this circuit on again, valve 82 remains in open position for line 78 and valve 86 switches to a fully open position of circulation line 42.

The compressor is actuated in the same direction as for draining and the pump is controlled in the opposite direction to draining so as to extract the water contained in the tank and circulate it in line 78 as shown by arrows R, as mentioned above.

Figure 2:
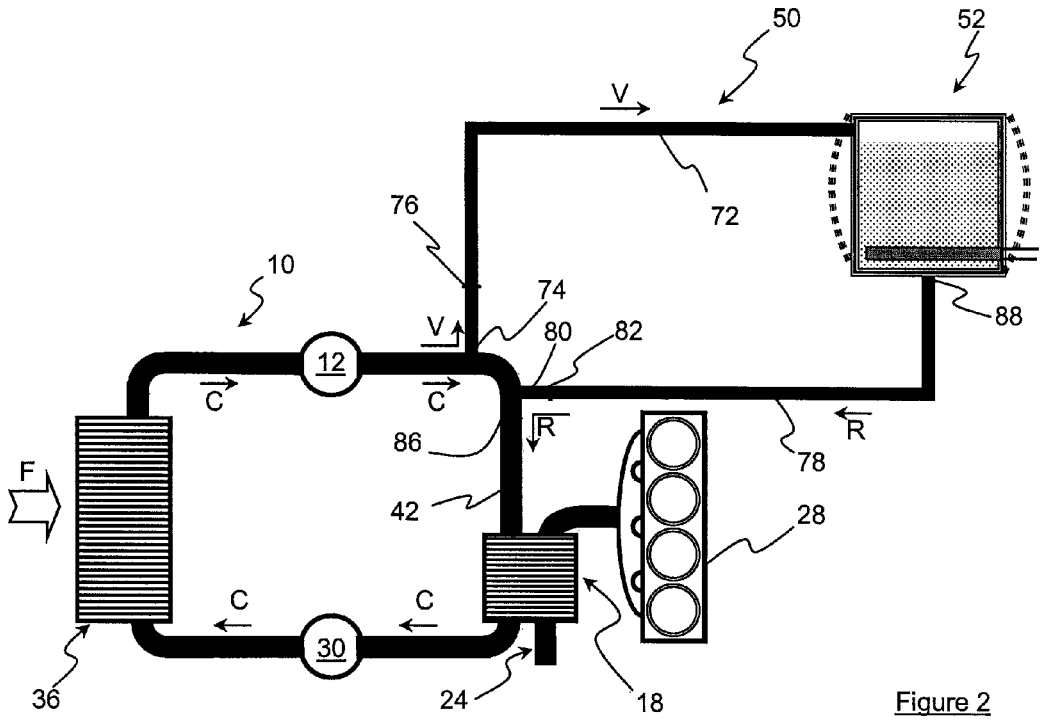
FIG. 2 illustrates a variant of the device of FIG. 1.

The variant of FIG. 2 differs from the example of FIG. 1 by a specific position of tank 52 and the removal of the circulation pump on filling line 78.

As can be seen in FIG. 2, the tank is positioned with respect to circuit 10 in such a way that connection point 88 between filling line 78 and the tank, arranged here in the bottom of this tank, is located above junction point 80 between this line and circulation line 42.

For this variant, the operation of the circuit is the same as in FIG. 1, with closing of valves 76 and 82, opening of valve 86 and water circulation according to arrows C under the action of compressor 12.

The stage of draining the water from the circuit into tank 52 so as to turn off the circuit is also identical to FIG. 1, with closing of valves 82 and 86, opening of valve 76 and actuation of compressor 12 in order to circulate the water as shown by arrows V.

For the circuit filling stage, valve 76 is in closed position for line 72, valves 82, 86 are in open position for lines 78 and 42, and compressor 12 is actuated.

Due to gravity, the water contained in the tank flows through connection point 88 and circulates in filling line 78, then in circulation line 42 as shown by arrows R.

Of course, without departing from the scope of the invention, it is possible to drain the circuit, after turning it off, only if the ambient temperature is likely to cause freezing of the water contained in the circuit, notably when it is below its freezing temperature.

A dedicated temperature detector or the detector associated with heating system 66 can be used for this purpose.

The invention claimed is:

1. A device for controlling a working fluid with a low freezing point circulating in a closed circuit operating according to a Rankine cycle, the circuit comprising a compression pump for the fluid in liquid form, a heat exchanger swept by a hot source for evaporation of the fluid, expansion means for expanding the fluid in vapour form and a cooling exchanger swept by a cold source for condensation of the working fluid, characterized in that the device comprises a fluid collection tank provided outside and connected to the circuit and configured to drain the circuit while the circuit is turned off, characterized in that the device comprises a first line connecting the circuit to the tank for draining off the fluid from the circuit into the tank and a second line connecting the tank to the circuit for filling the circuit with the fluid from the tank, at least one of the first line and the second line comprises a valve, and the second line for filling the circuit with the fluid from the tank includes a fluid circulation pump configured to drain the fluid from the tank into the circuit, and characterized in that the tank comprises a heating system for the fluid contained in the tank.

2. The device as claimed in claim 1, characterized in that the tank is an insulated tank.

3. The device as claimed in claim 1, characterized in that the tank is an expansible tank.

4. The device as claimed in claim 1, characterized in that a capacity of the tank is larger than the volume of the fluid contained in the circuit.

5. The device as claimed in claim 1, characterized in that at least one of the first line for draining off the fluid from the circuit into the tank and the second line for the filling circuit with the fluid from the tank comprises the fluid circulation pump.

6. The device as claimed in claim 1, characterized in that at least one of the first line for draining off the fluid from the circuit into the tank and the second line for the filling circuit with the fluid from the tank is connected to a point of a circulation line between the compression pump and the heat exchanger for evaporation of the fluid.

7. The device as claimed in claim 6, characterized in that the circulation line carries a valve arranged between the point and the heat exchanger for evaporation of the fluid.

8. The device as claimed in claim 1, characterized in that the fluid is water without an antifreeze additive.

9. The device as claimed in claim 1, characterized in that the hot source comes from an exhaust gas of an internal-combustion engine for a motor vehicle.

10. The device as claimed in claim 1, wherein the tank is configured to drain substantially all of the fluid in the circuit.

11. The device as claimed in claim 1, wherein the tank is disposed outside the circuit.

12. The device as claimed in claim 1, wherein the first line for draining off the fluid from the circuit into the tank and the second line for filling the circuit with the fluid from the tank are connected to a section of the circuit configured to feed the working fluid from the compression pump to the heat exchanger swept by the hot source for evaporation of the fluid.

13. The device as claimed in claim 1, further comprising a processing unit controlling the fluid circulation pump to stop operation of the fluid circulation pump after feeding all of the fluid from the tank into the circuit.

14. The device as claimed in claim 1, further comprising a processing unit configured to control the valve and the fluid circulation pump to drain the fluid from the circuit into the tank while the circuit is turned off.

15. A method of controlling a working fluid with a low freezing point circulating in a closed circuit operating according to a Rankine cycle, the circuit comprising a compression pump for the fluid in liquid form, a heat exchanger swept by a hot source for evaporation of the fluid, expansion means for expanding the fluid in vapour form and a cooling exchanger swept by a cold source for condensation of the working fluid, characterized in that the method comprises, while the circuit is turned off, transferring at least part of the fluid contained in the circuit into a tank provided outside and connected to the circuit, and characterized in that the method further comprises draining the fluid from the tank into the circuit through a line connecting the tank to the circuit under the action of a circulation pump carried by the line connecting the tank to the circuit, and that the method comprises heating the fluid contained in the tank.

16. The method as claimed in claim 15, characterized in that the method further comprises transferring the fluid to the tank, while the circuit is turned off, when the ambient temperature is below a freezing temperature of the fluid.

17. The method as claimed in claim 15, characterized in that the method further comprises transferring the fluid contained in the tank to the circuit when the circuit is turned on.

18. The method as claimed in claim 15, characterized in that the method further comprises circulating the fluid in the line connecting the circuit to the tank under the action of the compression pump.

19. The method as claimed in claim 15, wherein the method further comprises, while the circuit is turned off, transferring substantially all of the fluid contained in the circuit into the tank.

20. The method as claimed in claim 15, wherein the tank is disposed outside the circuit.

21. The method as claimed in claim 15, wherein the line connecting the tank to the circuit is connected to a section of the circuit configured to feed the working fluid from the compression pump to the heat exchanger swept by the hot source for evaporation of the fluid.

22. The method as claimed in claim 15, wherein operation of the fluid circulation pump is stopped after feeding all of the fluid from the tank into the circuit.

23. The method as claimed in claim 15, wherein the hot source comes from the exhaust gas of an internal-combustion engine for a motor vehicle.

24. The method as claimed in claim 15, wherein said transferring at least part of the fluid contained in the circuit into a tank provided outside and connected to the circuit comprises transferring at least part of the fluid contained in the circuit into the tank through a line different from the line connecting the tank to the circuit under the action of a circulation pump through which the fluid from the tank is drained into the circuit.

* * * * *